US012352059B2

(12) United States Patent
McManus

(10) Patent No.: US 12,352,059 B2
(45) Date of Patent: Jul. 8, 2025

(54) PUMP JACK WEDGE DEVICE

(71) Applicant: Timothy J. McManus, Lake Stevens, WA (US)

(72) Inventor: Timothy J. McManus, Lake Stevens, WA (US)

( * ) Notice: Subject to any disclaimer, the term of this patent is extended or adjusted under 35 U.S.C. 154(b) by 28 days.

(21) Appl. No.: 18/510,946

(22) Filed: Nov. 16, 2023

(65) Prior Publication Data

US 2024/0392587 A1 Nov. 28, 2024

Related U.S. Application Data

(60) Provisional application No. 63/503,589, filed on May 22, 2023.

(51) Int. Cl.
*E04G 3/22* (2006.01)
*E04G 5/04* (2006.01)

(52) U.S. Cl.
CPC ..... *E04G 5/041* (2013.01); *E04G 3/22* (2013.01)

(58) Field of Classification Search
None
See application file for complete search history.

(56) References Cited

U.S. PATENT DOCUMENTS 3,074,512 A * 1/1963 Naur ..... B60P 7/12 D12/217
3,879,014 A * 4/1975 Larson ..... B66F 7/243 254/94
5,249,397 A 10/1993 Monaco
5,307,899 A 5/1994 Lubinski
5,379,987 A * 1/1995 Cleary ..... B66F 3/38 254/DIG. 4
5,788,204 A * 8/1998 Goodwin ..... E04G 5/02 248/237
6,045,122 A * 4/2000 Torres ..... B66F 7/0608 254/122
6,264,169 B1 * 7/2001 Hung ..... B66F 5/04 254/8 B
6,732,480 B1 5/2004 Smith
7,726,445 B2 6/2010 Parnell
9,751,736 B1 * 9/2017 Fortin ..... B66F 3/25
10,662,707 B2 5/2020 Koeman, IV
2002/0153514 A1 * 10/2002 Wixey ..... B66F 5/04 254/8 B
2002/0192061 A1 * 12/2002 Brehmer ..... B66F 7/243 414/430
2006/0277863 A1 12/2006 Henning
2008/0099750 A1 * 5/2008 Arzouman ..... B66F 5/04 254/8 B

* cited by examiner

*Primary Examiner* — Steven M Marsh
(74) *Attorney, Agent, or Firm* — Brennan, Manna & Diamond, LLC

(57) ABSTRACT

A pump jack wedge device is provided. The device is comprised of at least one, generally, triangular-shaped wedge comprised of at least one opening to accept a pole of a pump jack post system or another scaffolding system used for working on angled roofs or other pitched exterior surfaces. Furthermore, the wedge is comprised of at least one mounting plate that secures the wedge to at least one roof or other exterior surface. The wedge may be a plurality of dimensions able to accommodate varying roof or other exterior surface pitches known in the art.

20 Claims, 7 Drawing Sheets

PUMP JACK WEDGE DEVICE

CROSS-REFERENCE TO RELATED APPLICATION

The present application claims priority to, and the benefit of, U.S. Provisional Application No. 63/503,589, which was filed on May 22, 2023, and is incorporated herein by reference in its entirety.

FIELD OF THE INVENTION

The present invention relates generally to the field of scaffolding. More specifically, the present invention relates to a pump jack wedge device designed to aid in exterior housing work by providing a flat surface that receives scaffolding while on a pitched roof. Accordingly, the present disclosure makes specific reference thereto. Nonetheless, it is to be appreciated that aspects of the present invention are also equally applicable to other like applications, devices, and methods of manufacture.

BACKGROUND

Performing construction or other exterior labor work often requires working on various angled and pitched roofs. Additionally, it is difficult to maintain balance while working on said angled and pitched surfaces. Moreover, working on angled roofs or other pitched surfaces can lead to serious injury and harm if a worker does not have proper footing and stabilization. Furthermore, it can be difficult to utilize articulate and boom lifts, scaffolding, and other structures of the like during construction or other exterior surface work on moderate to extreme angled roof pitches. This challenge can add serious time, manpower, and risk to completing construction or other exterior labor work.

Therefore, there exists a long-felt need in the art for a device that allows a user to use a pump jack post system or scaffolding system on angled roofs or other exterior angled surfaces. More specifically, there exists a long-felt need in the art for a pump jack wedge device that may be applied to any angled roof (or another angled surface) to support a pump jack post system or another scaffolding system by providing a flat surface for the base of the system. Furthermore, there exists a long-felt need in the art for a pump jack wedge device that allows workers to safely use scaffolding on a pitched roof or another angled surface.

The subject matter disclosed and claimed herein, in one embodiment thereof, comprises a pump jack wedge device. The device is comprised of at least one, generally, triangular-shaped wedge. Additionally, the wedge is comprised of at least one opening to accept a pole of a pump jack post system or another scaffolding system used for working on angled roofs or other pitched exterior surfaces. Furthermore, the wedge is comprised of at least one mounting plate that secures the wedge to at least one roof or other exterior surface. The wedge may be a plurality of dimensions able to accommodate varying roof or other exterior surface pitches known in the art.

In this manner, the pump jack wedge device of the present invention accomplishes all the foregoing objectives and provides a device that may be applied to any pitched roof to support a pump jack post system or another scaffolding system. More specifically, the pump jack wedge device may be applied to any roof to support a pump jack post system or another scaffolding system that allows workers to safely work on angled roofs or other pitched exterior surfaces while maintaining proper balance by providing a flat surface for the pump jack post system. Furthermore, the device may be universally applied to any angled or pitched roof known in the art.

SUMMARY

The following presents a simplified summary to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a pump jack wedge device comprised of a generally triangular-shaped body that may support at least one jack post base or other scaffolding system structure known in the art. The base of the device creates a flat surface, which is not parallel to the bottom surface of the device, which may support at least one jack post base or another scaffolding system to provide a stable, flat work surface for construction or other exterior workers.

Additionally, the base is comprised of at least one opening. The opening accepts at least one jack post base or another scaffolding system base. The base also has at least one top surface comprised of a flat surface that overcomes the angle or pitch of at least one roof by forming an acute angle with the bottom surface of the base and the mounting plate. The acute angle formed may be any angle to overcome any roof pitch known in the art, such as, but not limited to 10-45 degrees.

The base may also be comprised of at least one grip area. The grip area is within the opening of the base that accepts at least one jack post base or another scaffolding system. The grip area is designed to secure at least one jack post base or another scaffolding system and prevent it from moving, sliding, or rotating within the opening during use.

In another embodiment, the base is comprised of at least one fastener. The fastener secures at least one jack post base or another scaffolding system to the base of the device by tightening, clamping, or tying it down. The fastener prevents at least one jack post base, or another scaffolding system known in the art from moving, sliding, or rotating during use.

Additionally, the opening is comprised of at least one side wall. The side walls are comprised of at least one grip area that prevents at least one jack post base or another scaffolding system from moving, sliding, or rotating during use. In another embodiment, the side walls also provide an opening for the fastener to secure at least one jack post base or another scaffolding system to the device.

The base is also comprised of at least one bottom surface. The bottom surface acts as a means of attaching the base with at least one mounting plate. The mounting plate mounts the device to at least one angled or pitched roof during use. The mounting plate also creates an acute angle with the top surface enabling at least one jack post base or another scaffolding system to have a stable base to secure with during the use of the device. The mounting plate is comprised of at least one opening. The opening allows at least one fastener to fix the device to at least one angled or pitched roof.

The present invention is also comprised of a method of using the device. First, a device is provided comprised of at least one base, at least one mounting plate, and at least one fastener. Then, at least one mounting plate is attached to at least one angled or pitched roof by at least one grip area and at least one fastener. Then, at least one fastener is fastened to at least one opening of at least one mounting plate to removably secure at least one jack pole wedge device to at least one angled or pitched roof. Then, at least one jack post base or another scaffolding system is inserted into at least one opening of at least one base. At least one jack post base or another scaffolding system is secured to at least one base by at least one grip area.

The present invention is also comprised of a second method of using the device. First, a device is provided comprised of at least one base, at least one mounting plate, and at least one fastener. Then, at least one mounting plate is attached to at least one angled or pitched roof by at least one grip area and at least one fastener. Then, at least one fastener is fastened to at least one opening of at least one mounting plate to removably secure at least one jack pole wedge device to at least one angled or pitched roof. Then, at least one jack post base or another scaffolding system is inserted into at least one opening of at least one base. In one embodiment, at least one fastener is screwed, clamped, tied down, etc., to secure at least one jack post base or another scaffolding system in place for the use of the device.

Accordingly, the pump jack wedge device of the present invention is particularly advantageous as it provides a device that supports a pump jack post system or another scaffolding system. More specifically, the pump jack wedge device may be applied universally to any pitched or angled roof to accept a pump jack post system or another scaffolding system. Furthermore, the device can provide construction or other exterior labor workers with proper balance and footing while working on angled roofs or other exterior surfaces. Moreover, the pump jack wedge device may accommodate various roof angles with different wedge dimensions to safely provide support for any construction or other exterior surface work. In this manner, the pump jack wedge device provides a solution to problems faced with existing roof scaffolding devices, and methods known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
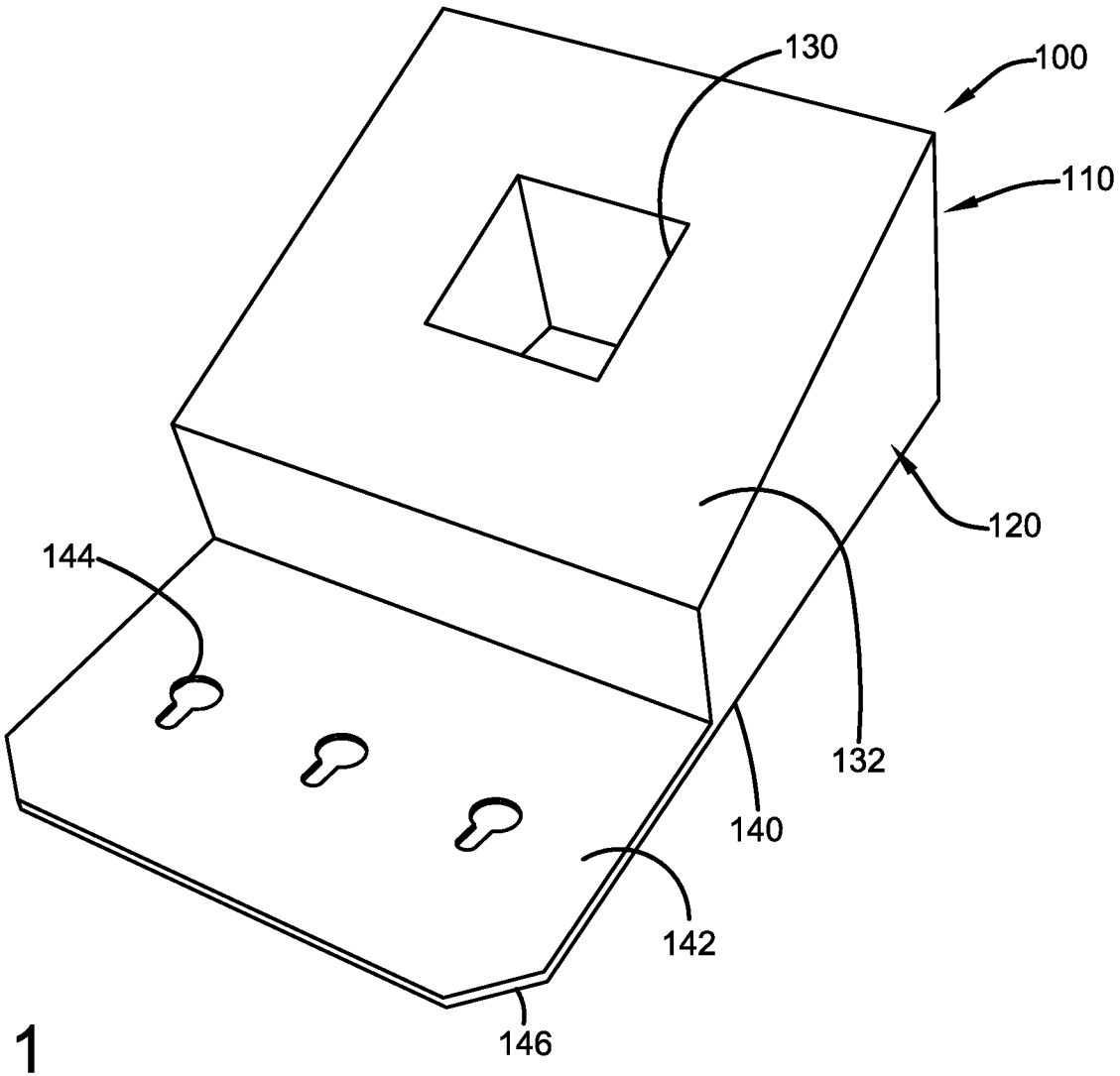
FIG. 1 illustrates a perspective view of one potential embodiment of a pump jack wedge device of the present invention in accordance with the disclosed architecture.

The innovation is now described with reference to the drawings, wherein like reference numerals are used to refer to like elements throughout. In the following description, for purposes of explanation, numerous specific details are set forth to provide a thorough understanding thereof. It may be evident, however, that the innovation can be practiced without these specific details. In other instances, well-known structures and devices are shown in block diagram form to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a device that allows a user to use a pump jack post system or scaffolding system on angled roofs or other exterior angled surfaces. More specifically, there exists a long-felt need in the art for a pump jack wedge device that may be applied to any angled roof (or another angled surface) to support a pump jack post system or another scaffolding system by providing a flat surface for the base of the system. Furthermore, there exists a long-felt need in the art for a pump jack wedge device that allows workers to safely use scaffolding on a pitched roof or another angled surface.

The present invention, in one exemplary embodiment, is comprised of a pump jack wedge device comprised of a triangular-shaped body that may support at least one jack post base or another scaffolding system. The base of the device creates a flat surface that may support at least one jack post base or another scaffolding system to provide a stable work surface for construction or other exterior workers. In the preferred embodiment, the base is a steel material. The flat surface is not parallel with the mounting plate to overcome the angle or pitch of the roof.

The base is also comprised of at least one opening that accepts at least one jack post base or another scaffolding system known in the art. The opening secures at least one jack post base or another scaffolding system to the base of the device by at least one grip area. The grip area prevents at least one jack post base or another scaffolding system from moving, sliding, or rotating during use. Additionally, the base has a top surface that removes the angle and pitch of at least one roof by forming an acute angle with the mounting plate.

In another embodiment, the base is not comprised of a grip surface and is comprised of a fastener. The fastener secures at least one jack post base or another scaffolding system to the base. The fastener tightens, clamps, or ties down at least one jack post base or another scaffolding system known in the art to prevent it from moving, sliding, or rotating during the use of the device.

The opening is also comprised of at least one side wall. The side walls are comprised of at least one grip area. In another embodiment, the side walls are an entry point for at least one fastener to secure at least one jack post base or another scaffolding system.

The base is also comprised of at least one bottom surface. The bottom surface is an attachment point for at least one mounting plate and the body of the device. The mounting plate mounts the device to at least one angled or pitched roof by at least one fastener. The fastener attaches to at least one angled or pitched roof through at least one opening on the mounting plate.

Moreover, the mounting plate is also comprised of at least one bottom surface. The bottom surface attaches the mounting plate to at least one grip area. The grip area provides friction as additional securement so the device does not move, slide, or rotate on at least one angled or pitched roof during the use of the device. The grip area also attaches to at least one fastener. The fastener provides further support to the attachment of at least one mounting plate and at least one angled or pitched roof.

The present invention is also comprised of a method of using the device. First, a device is provided comprised of at least one base, at least one mounting plate, and at least one fastener. Then, at least one mounting plate is attached to at least one angled or pitched roof by at least one grip area and at least one fastener. Then, at least one fastener is fastened to at least one opening of at least one mounting plate to removably secure at least one jack pole wedge device to at least one angled or pitched roof. Then, at least one jack post base or another scaffolding system is inserted into at least one opening of at least one base. At least one jack post base or another scaffolding system is secured to at least one base by at least one grip area.

The present invention is also comprised of a second method of using the device. First, a device is provided comprised of at least one base, at least one mounting plate, and at least one fastener. Then, at least one mounting plate is attached to at least one angled or pitched roof by at least one grip area and at least one fastener. Then, at least one fastener is fastened to at least one opening of at least one mounting plate to removably secure at least one jack pole wedge device to at least one angled or pitched roof. Then, at least one jack post base or another scaffolding system is inserted into at least one opening of at least one base. In one embodiment, at least one fastener is screwed, clamped, tied down, etc., to secure at least one jack post base or another scaffolding system in place for the use of the device.

Accordingly, the pump jack wedge device of the present invention is particularly advantageous as it provides a device that supports a pump jack post system or another scaffolding system. More specifically, the pump jack wedge device may be applied universally to any pitched or angled roof to accept a pump jack post system or another scaffolding system. Furthermore, the device can provide construction or other exterior labor workers with proper balance and footing while working on angled roofs or other exterior surfaces. Moreover, the pump jack wedge device may accommodate various roof angles with different wedge dimensions to safely provide support for any construction or other exterior surface work. In this manner, the pump jack wedge device provides a solution to problems faced with existing roof scaffolding device and methods known in the art.

Figure 5:
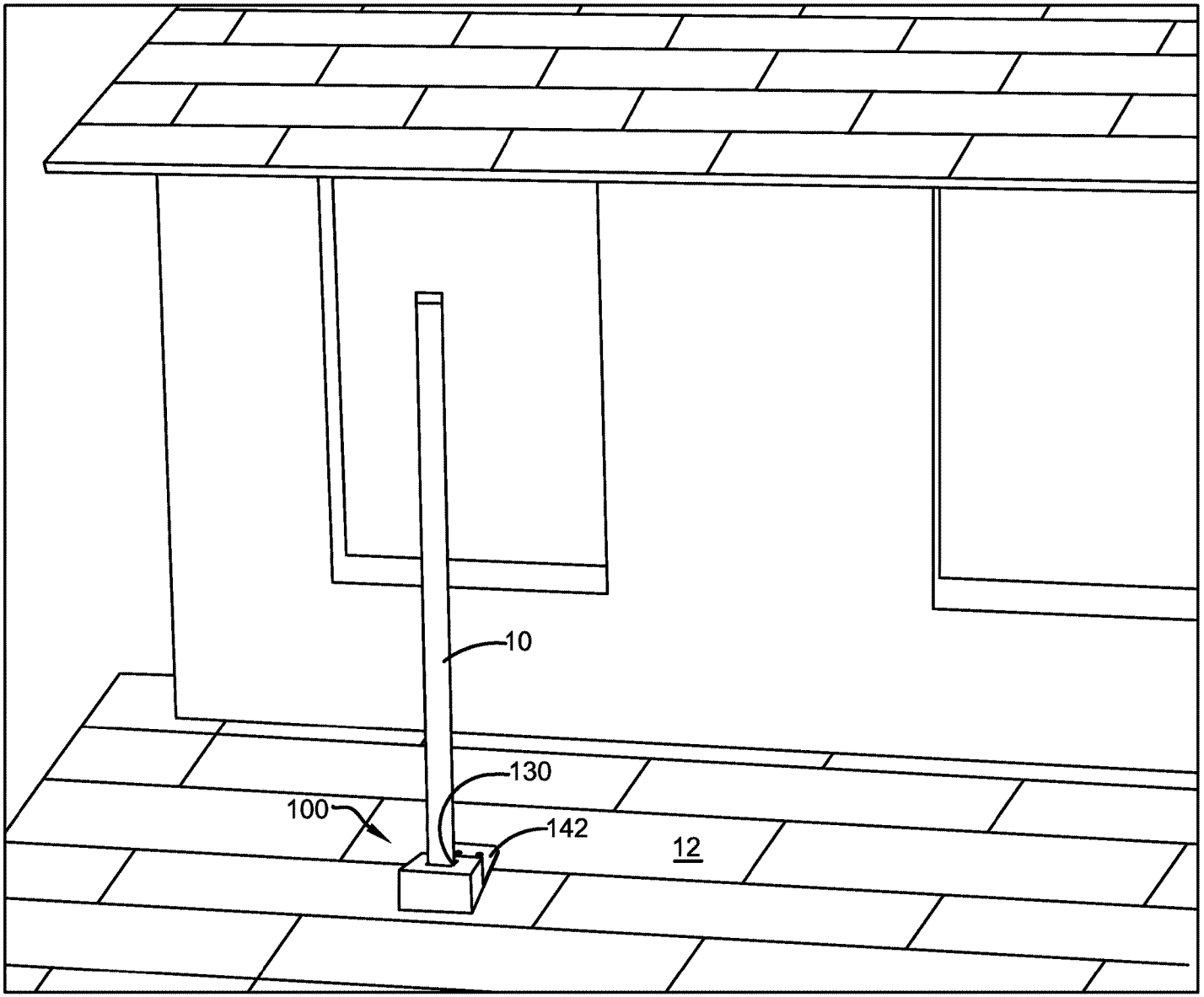
FIG. 5 illustrates a perspective view of one potential embodiment of a pump jack wedge device of the present invention while attached to a roof and while receiving a jack post in accordance with the disclosed architecture.

Referring initially to the drawings, FIG. 1 illustrates a perspective view of a body 110 of a pump jack wedge device 100. The body 110 is preferably generally triangular in shape and is comprised of at least one base 120 that may support at least one jack post base 10 or another base/leg structure of any scaffolding system known in the art (as best seen in FIG. 5). The base 120 creates a flat surface that may accept at least one jack post base 10 or another scaffolding system to provide a flat, stable, and secure area for a jack post base 10 or other scaffolding system. The base 120 may be made of a plurality of materials known in the art, such as, but not limited to, metal, plastic, wood, etc. However, in the preferred embodiment, the base 120 is made of steel to provide durable and strong support for at least one jack post base 10 or another scaffolding system.

Additionally, the base 120 is comprised of at least one opening 130. The opening 130 receives at least one jack post base 10 or another scaffolding system leg/base and secures the jack post base 10 to properly support any scaffolding system known in the art. Furthermore, the base 120 has at least one top surface 132. The top surface 132 provides a flat surface that allows any scaffolding system known in the art to overcome the pitch of a roof 12 during the preferred use of the device 100. In the preferred embodiment, the top surface 132 is not parallel with the bottom surface 140 of a mounting plate 142 of the device 100, wherein the top surface 132 forms an acute angle with the mounting plate 142. The acute angle may be a plurality of dimensions to accommodate various roof pitches known in the art, such as, but not limited to 10 to 45 degrees.

Figure 2:
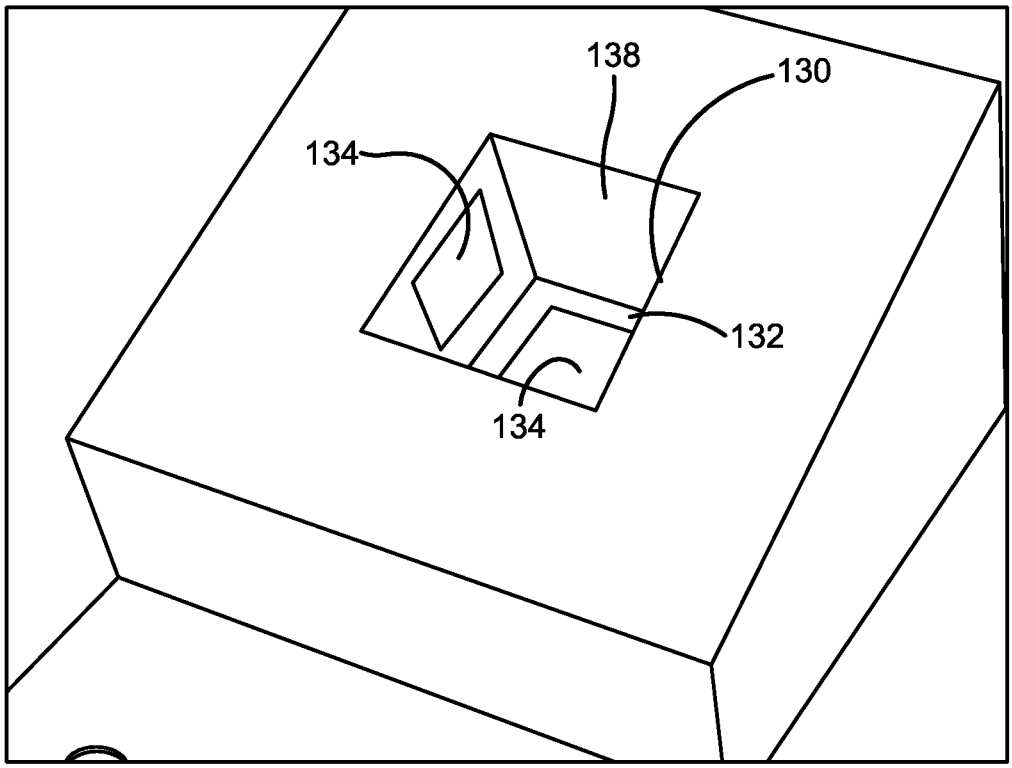
FIG. 2 illustrates an enhanced top perspective view of one potential embodiment of a pump jack wedge device of the present invention in accordance with the disclosed architecture.

Moreover, the base 120 is also comprised of at least one grip area 134. The grip area 134 is positioned on the top surface 132 of the opening 130, as seen in FIG. 2. Additionally, the grip area 134 may be affixed to at least one side wall 138 and the top surface 132 of the opening 130. The grip area 134 prevents the jack post base 10 or another scaffolding system from sliding, moving, or rotating while secured in the opening 130 of the base 120. The grip area 134 may be comprised of any non-slip material known in the art, such as, but not limited to, rubber, silicone, foam, etc. Furthermore, the grip area 134 may be comprised of a raised or recessed texture to facilitate better grip and adherence of the jack post base 10 or another scaffolding system to the base 120.

Figure 3:
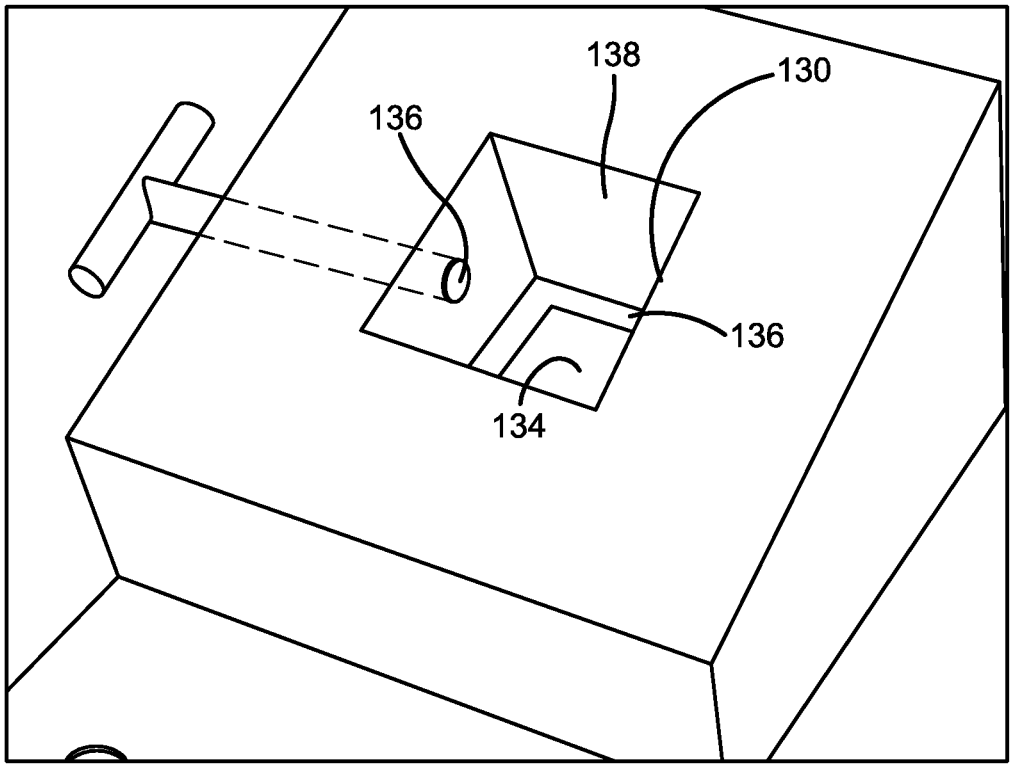
FIG. 3 illustrates an enhanced top perspective view of one potential embodiment of a pump jack wedge device of the present invention in accordance with the disclosed architecture.

In one embodiment, the base 120 only has the grip area 134 to secure the jack post base 10 or another scaffolding system in place. In a further embodiment, the base 120 is also or alternatively, comprised of at least one fastener 136, as seen in FIG. 3. The fastener 136 acts as an additional means to secure the jack post base 10 or another scaffolding system in place within the opening 130 and prevents said base 10 from sliding, moving, or rotating while construction or other exterior surface workers are using the device 100. The fastener 136 may be comprised of any type of fastener known in the art, such as, but not limited to, a male and female thread fastener, a clamp, a magnet, a tic-down, a clip, a threaded set screw, etc.

The opening 130 is also comprised of at least one side wall 138, as seen in FIG. 3. The side walls 138 act as a means to affix the grip area 134 to prevent the jack post base 10 or another scaffolding system from sliding, moving, or rotating during use of the device 100. Additionally, the side walls 138 may provide an opening for the fastener 136 to attach to the jack post base 10 or another scaffolding system to prevent the jack post base 10 or another scaffolding system from sliding, moving, or rotating during the use of the device 100.

The base 120 is also comprised of a mounting plate 140 with at least one bottom surface 140. The mounting plate 142 attaches the body 110 of the device 100 to at least one angled or pitched roof 12, as seen in FIG. 5. The mounting plate 142 forms an acute angle with the top surface 132 of the base 120 so that the jack post base 10 or another scaffolding system can be used on at least one angled or pitched roof 12, wherein the opening 130 remains flat (i.e., 0 degrees).

Figure 4:
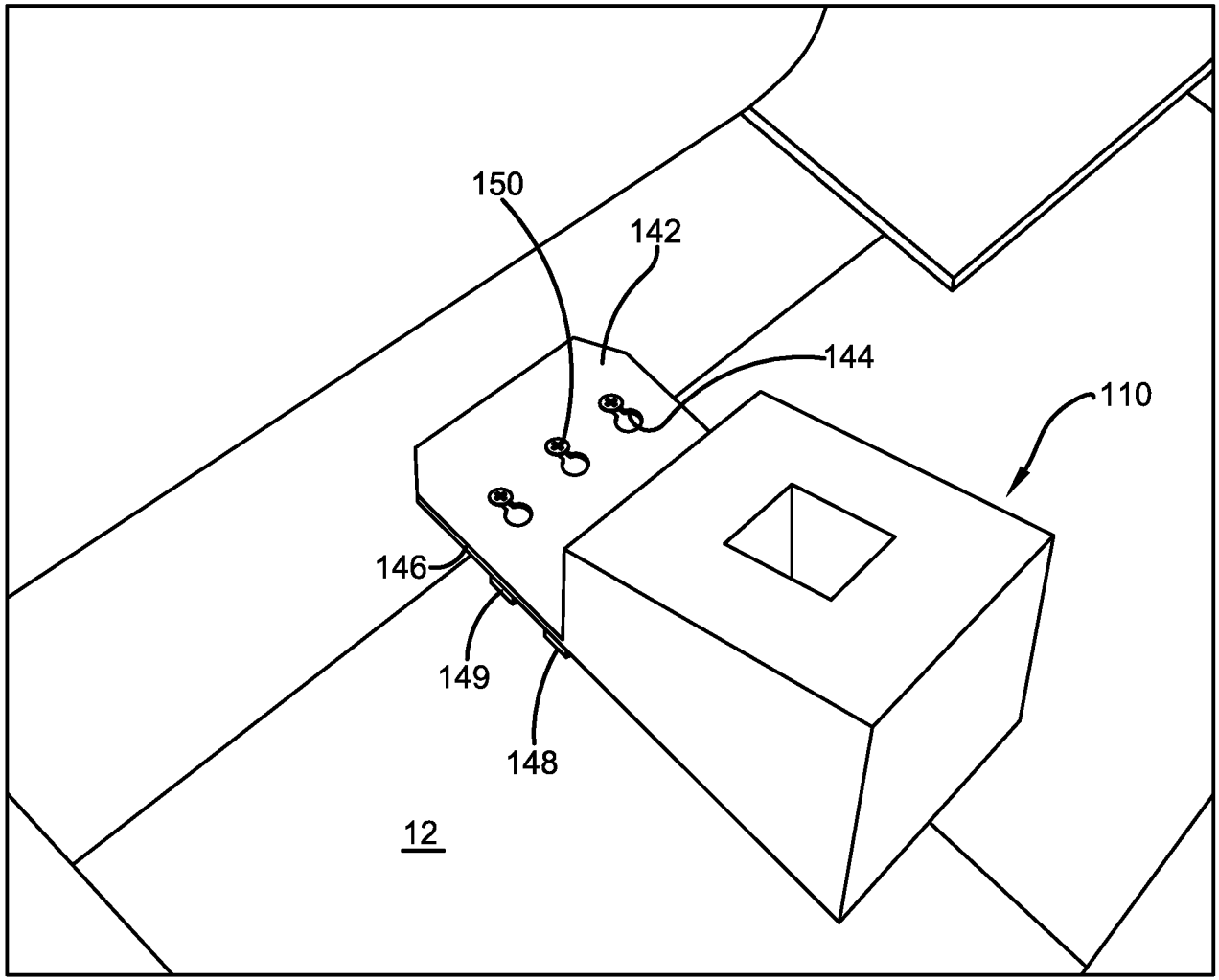
FIG. 4 illustrates a perspective view of one potential embodiment of a pump jack wedge device of the present invention while attached to a roof in accordance with the disclosed architecture.

Additionally, the mounting plate 142 is comprised of at least one opening 144. The opening 144 allows at least one fastener 150 to secure the device 100 to at least one angled or pitched roof 12, as seen in FIG. 4. The fastener 150 can be any fastener known in the art, such as, but not limited to, a screw, a lag screw, a rivet, a threaded rod, an anchor bolt, a nail, etc. The mounting plate 142 is also comprised of at least one bottom surface 146.

The bottom surface 146 of the mounting plate 142 may be comprised of at least one grip area 148 that provides friction between the mounting plate 142 and a roof 12 to prevent the body 110 of the device 100 from slipping, moving, or rotating during use. The grip area 148 may be comprised of any non-slip material known in the art, such as, but not limited to, rubber, silicone, foam, etc. Furthermore, the grip area 148 may be comprised of a raised or recessed texture to facilitate better grip and adherence of the mounting plate 142 to a roof 12.

Furthermore, the grip area 148 may be comprised of at least one fastener 149, as seen in FIG. 4. The fastener 149 is a further means of adhering the device 100 to at least one angled or pitched roof 12. The fastener 149 may be any fastener known in the art, such as, but not limited to, at least one spike, anchor, screw, bolt, stud, etc.

Figure 6:
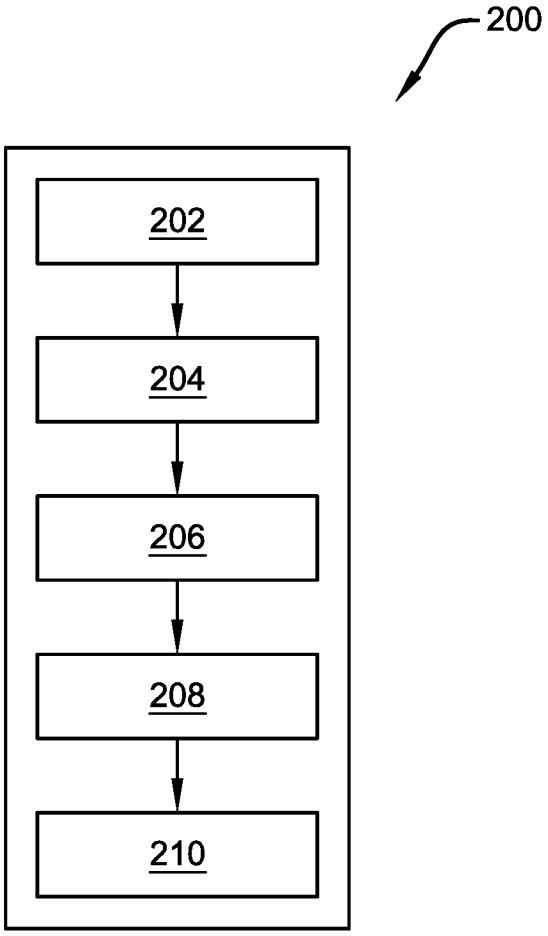
FIG. 6 illustrates a flowchart of a method of using one potential embodiment of a pump jack wedge device of the present invention in accordance with the disclosed architecture.

The present invention is also comprised of a method of using 200 the device 100, as seen in FIG. 6. First, a device 100 is provided comprised of at least one base 120 with an opening 130, at least one mounting plate 142, and at least one fastener 150 [Step 202]. Then, at least one mounting plate 142 is attached to at least one angled or pitched roof 12 by at least one grip area 148 and/or at least one fastener 149 [Step 204]. Then, at least one fastener 150 is fastened to at least one opening 144 of at least one mounting plate 142 to removably secure at least one jack pole wedge device 100 to at least one angled or pitched roof 12 [Step 206]. Next, at least one jack post base 10 or another scaffolding system is inserted into at least one opening 130 of at least one base 120 [Step 208]. At least one jack post base 10 or another scaffolding system is then secured to at least one base 120 by at least one grip area 134 [Step 210].

Figure 7:
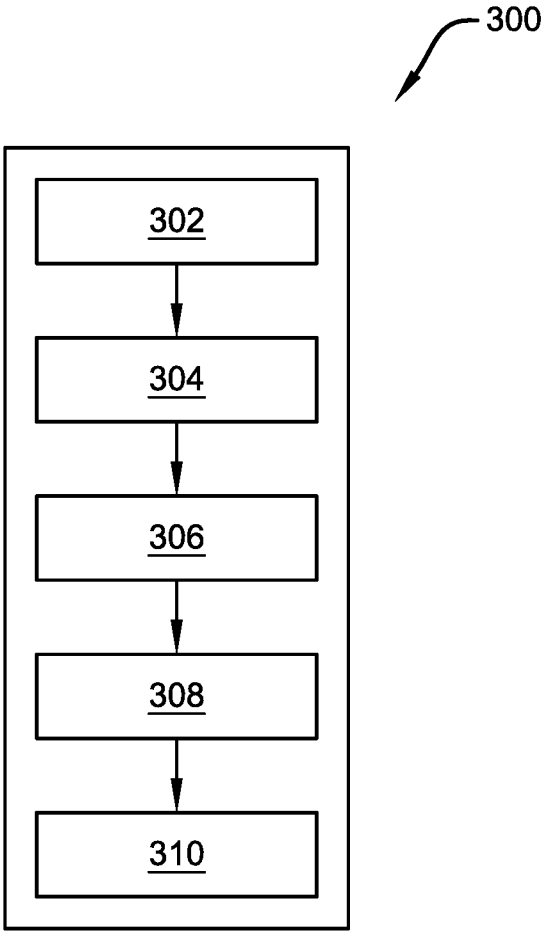
FIG. 7 illustrates a flowchart of a method of using one potential embodiment of a pump jack wedge device of the present invention in accordance with the disclosed architecture.

The present invention is also comprised of a second method of using 300 the device 100, as seen in FIG. 7. First, a device 100 is provided comprised of at least one base 120 with an opening 130, at least one mounting plate 142, and at least one fastener 150 [Step 302]. Then, at least one mounting plate 142 is attached to at least one angled or pitched roof 12 by at least one grip area 148 and/or at least one fastener 149 [Step 304]. Then, at least one fastener 150 is fastened to at least one opening 144 of at least one mounting plate 142 to removably secure at least one jack pole wedge device 100 to at least one angled or pitched roof 12 [Step 306]. Next, at least one jack post base 10 or another scaffolding system is inserted into at least one opening 130 of at least one base 120 [Step 308]. In this embodiment, at least one fastener 136 is then used to secure at least one jack post base 10 or another scaffolding system within the opening 130 [Step 310].

Certain terms are used throughout the following description and claims to refer to particular features or components. As one skilled in the art will appreciate, different persons, may refer to the same feature or component by different names. This document does not intend to distinguish between components or features that differ in name but not structure or function. As used herein "pump jack wedge device" and "device" are interchangeable and refer to the pump jack wedge device 100 of the present invention.

Notwithstanding the foregoing, the pump jack wedge device 100 of the present invention and its various components can be of any suitable size and configuration as is known in the art without affecting the overall concept of the invention, provided that they accomplish the above-stated objectives. One of ordinary skill in the art will appreciate that the size, configuration, and material of the pump jack wedge device 100 as shown in the FIGS. are for illustrative purposes only, and that many other sizes and shapes of the pump jack wedge device 100 are well within the scope of the present disclosure. Although the dimensions of the pump jack wedge device 100 are important design parameters for user convenience, the pump jack wedge device 100 may be of any size, shape, and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A pump jack wedge device comprising:

a base comprised of a first opening, a top surface and a side wall; and a mounting plate attached to the base, wherein the mounting plate is comprised of a second opening, and further wherein the mounting plate forms an acute angle with the top surface.

2. The pump jack wedge device of claim 1, wherein a first fastener is positioned on a bottom surface of the mounting plate.

3. The pump jack wedge device of claim 2, wherein the first fastener is comprised of a spike, an anchor, a screw, a bolt or a stud.

4. The pump jack wedge device of claim 1 further comprising a second fastener.

5. The pump jack wedge device of claim 4, wherein the second fastener is comprised of a threaded fastener, a clamp, a magnet, a tie-down, a clip or a threaded set screw.

6. A pump jack wedge device comprising:

a base comprised of a first opening, a top surface and a side wall;

a first grip area;

a mounting plate attached to the base and comprised of a second opening, wherein the mounting plate forms an acute angle with the top surface; and a second grip area positioned on a bottom surface of the mounting plate.

7. The pump jack wedge device of claim 6, wherein the bottom surface of the mounting plate is comprised of a fastener.

8. The pump jack wedge device of claim 6, wherein the second grip area is comprised of a non-slip material.

9. The pump jack wedge device of claim 8, wherein the second grip area is comprised of a raised or recessed texture.

10. The pump jack wedge device of claim 6, wherein the second grip area is comprised of a first fastener.

11. The pump jack wedge device of claim 10, wherein the first fastener is comprised of a spike, an anchor, a screw, a bolt or a stud.

12. The pump jack wedge device of claim 10 further comprised of a second fastener that is positioned within the opening.

13. The pump jack wedge device of claim 12, wherein the second fastener is comprised of a threaded set screw.

14. The pump jack wedge device of claim 6, wherein the first grip area is comprised of a non-slip material.

15. The pump jack wedge device of claim 6, wherein the first grip area is positioned on the sidewall of the opening.

16. The pump jack wedge device of claim 6, wherein the first grip area is positioned on the top surface of the opening.

17. A method of using a pump jack wedge device, the method comprising the following steps:

providing a pump jack wedge device comprised of a base attached to a mounting plate at an acute angle, wherein the base comprises an opening;

attaching the mounting plate to a roof via fastening a first fastener through an opening of the mounting plate; and securing a jack post base into the opening of the base.

18. The method of claim 17 further comprising a step of using a second fastener to secure the jack post base within the opening.

19. The method of claim 17 further comprising a step of securing a scaffolding system into the opening of the base.

20. The method of claim 17, wherein the jack post base is secured within the opening via a grip area of the opening.

* * * * *